US011464333B2

(12) United States Patent
Meusburger et al.

(10) Patent No.: US 11,464,333 B2
(45) Date of Patent: Oct. 11, 2022

(54) LOADING RAIL FOR A PULL-OUT GUIDE FOR A DRAWER

(71) Applicant: Julius Blum GmbH, Hoechst (AT)

(72) Inventors: Marc Meusburger, Egg (AT); Markus Kampl, Dornbirn (AT)

(73) Assignee: JULIUS BLUM GMBH, Hoechst (AT)

( * ) Notice: Subject to any disclaimer, the term of this patent is extended or adjusted under 35 U.S.C. 154(b) by 0 days.

(21) Appl. No.: 16/940,665

(22) Filed: Jul. 28, 2020

(65) Prior Publication Data

US 2020/0352327 A1 Nov. 12, 2020

Related U.S. Application Data

(63) Continuation of application No. PCT/AT2018/060317, filed on Dec. 21, 2018.

(30) Foreign Application Priority Data

Feb. 1, 2018 (AT) ..... A 50097/2018

(51) Int. Cl.
*A47B 88/473* (2017.01)
*A47B 88/423* (2017.01)
*A47B 88/483* (2017.01)

(52) U.S. Cl.
CPC ..... *A47B 88/473* (2017.01); *A47B 88/423* (2017.01); *A47B 88/483* (2017.01)

(58) Field of Classification Search
CPC ... A47B 88/473; A47B 88/423; A47B 88/483; A47B 88/493; A47B 88/487; A47B 88/407
See application file for complete search history.

(56) References Cited

U.S. PATENT DOCUMENTS 4,119,377 A 10/1978 Barber et al.
4,465,324 A * 8/1984 Rock ..... A47B 88/487 384/19

(Continued)

FOREIGN PATENT DOCUMENTS

AT 518980 B1 * 3/2018 ..... A47B 88/493
CH 568 735 11/1975

(Continued)

OTHER PUBLICATIONS

International Search Report dated Feb. 5, 2019 in International (PCT) Application No. PCT/AT2018/060317 with English-language translation.

(Continued)

*Primary Examiner* — Hanh V Tran
(74) *Attorney, Agent, or Firm* — Wenderoth, Lind & Ponack, L.L.P.

(57) ABSTRACT

A drawer rail for a drawer pull-out guide, including a first rail configured to be fixed to a drawer, and a second rail configured to be arranged on a carcass rail or on a central rail of a drawer pull-out guide. The first rail and the second rail are configured to be connected to one another by sliding onto each other, and a spring member is arranged on the first or second rail. A protrusion is arranged on the other rail, the position of which on and/or the extension of which along the other rail is chosen such that the protrusion, in a connected condition of the first and second rail, co-operates with the spring member so as to limit transverse movements of the two rails to one another.

19 Claims, 5 Drawing Sheets

(56) References Cited

U.S. PATENT DOCUMENTS

| | | | | | |
|---|---|---|---|---|---|
| 4,579,402 | A * | 4/1986 | Wenzlick | A47B 88/906 | 312/330.1 |
| 5,020,869 | A * | 6/1991 | Faust | A47B 88/427 | 312/334.15 |
| 5,281,021 | A * | 1/1994 | Rock | A47B 88/57 | 312/330.1 |
| 5,344,227 | A * | 9/1994 | Rock | A47B 88/467 | 312/334.33 |
| 5,439,284 | A * | 8/1995 | Grabber | A47B 88/427 | 312/334.6 |
| 5,492,400 | A * | 2/1996 | Rock | A47B 88/493 | 312/331 |
| 5,951,132 | A * | 9/1999 | Cirocco | A47B 88/493 | 312/334.46 |
| 5,980,007 | A * | 11/1999 | Singh | A47B 88/427 | 248/222.11 |
| 6,095,627 | A * | 8/2000 | Sutterlutti | A47B 88/427 | 312/263 |
| 6,257,683 | B1 * | 7/2001 | Yang | A47B 88/487 | 312/333 |
| 6,412,893 | B1 * | 7/2002 | Muterthies | A47B 88/941 | 312/330.1 |
| 6,416,145 | B1 | 7/2002 | Singh | | |
| 7,090,319 | B2 | 8/2006 | Milligan et al. | | |
| 7,654,625 | B2 | 2/2010 | Amann et al. | | |
| 8,162,415 | B2 * | 4/2012 | Hagele | F25D 23/062 | 312/198 |
| 8,807,672 | B2 * | 8/2014 | Gasser | A47B 88/427 | 312/333 |
| 9,198,322 | B2 * | 11/2015 | Russell | H05K 7/1489 | |
| 9,326,603 | B2 | 5/2016 | Iwamoto | | |
| 9,901,173 | B2 * | 2/2018 | Grabber | A47B 88/40 | |
| 10,092,100 | B1 * | 10/2018 | Chen | A47B 88/40 | |
| 10,334,950 | B2 * | 7/2019 | Chen | A47B 88/443 | |
| 10,362,869 | B2 * | 7/2019 | Gasser | A47B 88/41 | |
| 2001/0008037 | A1 * | 7/2001 | Brustle | E05F 5/027 | 16/71 |
| 2003/0034720 | A1 | 2/2003 | Milligan et al. | | |
| 2003/0209959 | A1 * | 11/2003 | Shih-Long | A47B 88/49 | 312/334.46 |
| 2004/0000851 | A1 * | 1/2004 | Lam Harn | A47B 88/493 | 312/334.7 |
| 2004/0245898 | A1 | 12/2004 | Amann et al. | | |
| 2008/0315740 | A1 * | 12/2008 | Lam | A47B 88/941 | 312/334.1 |
| 2011/0037366 | A1 * | 2/2011 | Lam | A47B 88/467 | 312/334.44 |
| 2013/0249369 | A1 * | 9/2013 | Gasser | A47B 88/423 | 312/334.32 |
| 2014/0339973 | A1 | 11/2014 | Fan et al. | | |
| 2015/0164223 | A1 * | 6/2015 | Lawson | A47B 88/941 | 312/334.5 |
| 2015/0245709 | A1 * | 9/2015 | Iwamoto | A47B 88/40 | 211/175 |
| 2017/0095080 | A1 * | 4/2017 | Chen | H05K 7/1489 | |
| 2017/0135476 | A1 * | 5/2017 | Chen | A47B 88/407 | |
| 2017/0135478 | A1 * | 5/2017 | Chen | A47B 88/46 | |
| 2017/0172300 | A1 * | 6/2017 | Bowman | A47B 88/487 | |
| 2019/0231070 | A1 * | 8/2019 | Meusburger | A47B 88/407 | |

FOREIGN PATENT DOCUMENTS

| | | | | |
|---|---|---|---|---|
| CN | 203302662 | | 11/2013 | |
| CN | 104873012 | | 9/2015 | |
| CN | 206518325 | | 9/2017 | |
| CN | 108720379 | A * | 11/2018 | |
| DE | 9402042 | | 5/1994 | |
| DE | 20 2006 000 519 | | 6/2006 | |
| DE | 102015203436 | A1 * | 9/2016 | F16C 29/004 |
| DE | 102017119909 | A1 * | 2/2019 | A47B 88/493 |
| EP | 1 316 275 | | 6/2003 | |
| EP | 1 483 984 | | 12/2004 | |
| EP | 2 901 891 | | 8/2015 | |
| EP | 2 913 610 | | 9/2015 | |
| EP | 3167756 | A1 * | 5/2017 | A47B 88/427 |
| EP | 3168483 | A1 * | 5/2017 | A47B 88/427 |
| ES | 2 239 249 | | 5/2004 | |
| JP | 2011-38620 | | 2/2011 | |
| JP | 2016-116555 | | 6/2016 | |
| JP | 6433779 | | 11/2018 | |
| TW | 201442672 | | 11/2014 | |
| WO | 98/47410 | | 10/1998 | |
| WO | WO-2017106889 | A1 * | 6/2017 | A47B 88/941 |

OTHER PUBLICATIONS

Search Report dated May 6, 2021 in corresponding Chinese Patent Application No. 201880088283.6.

* cited by examiner

A-A

LOADING RAIL FOR A PULL-OUT GUIDE FOR A DRAWER

BACKGROUND OF THE INVENTION

The present invention relates to a drawer rail for a drawer pull-out guide, the drawer rail comprising:

a first rail which is connected or which is configured to be connected to a drawer, and a second rail which is arranged or which is configured to be arranged on a carcass rail or on a central rail of a drawer pull-out guide, wherein the first rail and the second rail are configured to be connected to one another by sliding onto each other, and at least one spring means is arranged on the first or second rail.

Furthermore, the invention relates to a drawer pull-out guide comprising at least one drawer rail of the type to be described, and an item of furniture comprising a furniture carcass and a drawer displaceably supported relative to the furniture carcass. The first rail is pre-mounted to the drawer and the second rail is pre-mounted to the furniture carcass, wherein the first rail connected to the drawer can be connected to the second rail by sliding the first rail onto the second rail.

When a drawer is mounted for the first time to a drawer pull-out guide, usually a first rail is pre-mounted to the drawer, and the drawer pull-out guide having a second rail is pre-mounted to the furniture carcass. Subsequently, the drawer is slid with the first rail onto the second rail of the drawer pull-out guide, until an automatic locking between the first rail and the second rail is established. During normal operation, the first rail and the second rail are arranged non-displaceable relative to one another and jointly form, so to speak, a two-part drawer rail of the drawer pull-out guide. By a spring means arranged on the first or second rail, and the spring means is configured to be supported on the other rail, a clearance between the first and second rail occurring in a direction lateral to the longitudinal direction of the rails can be compensated for in a mounted condition of the rails. For example, the spring means can be in the form of a bendable spring tab or a spring tongue being stamped out from the material of a rail and by which the occurring clearance between the first and second rail can be compensated for. Depending on the size of the occurring clearance between the first and second rail, the spring tab or spring tongue is to be dimensioned relatively large, whereby besides an unattractive configuration, there is also the danger that the spring means can be damaged, for example by shearing-off the spring means.

EP 1 483 984 A1 discloses a drawer pull-out guide with a first rail arranged on a drawer, and the rail includes laterally protruding resilient tabs, as shown in FIGS. 8-10. On the front-end region of the extendable rail of the drawer pull-out guide, a functional carrier in the form of a plastic member is attached, and the resilient tabs of the first rail co-operate with step-shaped bearing surfaces of the functional carrier in a connected condition of the rails (FIG. 12). In this way, a length compensation and a centering of the first rail in relation to the functional carrier can be established. A drawback is the fact that the resilient tabs protrude relatively far from the first rail, and also the arrangement of a separate functional carrier is connected with additional costs.

SUMMARY OF THE INVENTION

It is an object of the present invention to propose a drawer rail of the type mentioned in the introductory part, thereby avoiding the above-discussed drawbacks.

According to the invention, at least one protrusion is arranged on the other rail, the position of which on and/or the extension of which along the other rail is chosen such that the at least one protrusion, in a connected condition of the first and second rail, co-operates with a spring element so as to limit transverse movements of the two rails to one another.

In other words, the spring element, in a connected condition of the two rails, bears against the protrusion of the other rail, so that the spring element can be formed with a reduced constructional height on a rail, for example with approximately a half of the constructional height. In this way, the danger of a damage of the spring element and the required amount of material for the spring element can be reduced. The remaining differing clearance between the rails can thus be compensated for by the protrusion arranged on the other rail, the protrusion bearing without clearance against the spring element in a mounted condition of the rails.

According to an embodiment, the first rail is configured to be slid onto the second rail, starting from a front-end region of the second rail, to a rear-end region of the second rail, and the at least one protrusion co-operates with the at least one spring element only over a partial region immediately preceding the rear-end region of the second rail. This has the particular advantage that the drawer with the first rail can be moved relative to the second rail over a large part of the sliding path with a reduced frictional resistance, without a spring element dragging along on one of the rails and without increasing the frictional resistance thereby. Only after the end of the sliding path, the spring element and the protrusion contact one another and compensate for the clearance between the two rails by mutual engagement.

Each of the first rail and the second rail can have a side limb extending in the longitudinal direction of the rails, and each of the at least one spring element and the at least one protrusion are formed or arranged on a side limb of the rails. Thereby, each of the at least one spring element and the at least one protrusion protrude transversely from the side limbs of the rails.

With a constructive simple embodiment, the at least one spring element and/or the at least one protrusion, together with the rails, can have an integral one-piece configuration.

The at least one spring element can be configured so as to be elastically bendable or so as to be reversibly deformable in a direction extending transversely to the longitudinal direction of the rail. Preferably, the at least one spring element is formed as a spring tab or a spring tongue arranged on one of the rails. For example, the spring tab or the spring tongue can be punched out from a metallic material of one of the rails. Alternatively, it is possible that the spring element includes at least one mechanical spring element, for example a compression spring.

The at least one protrusion can be configured so as to be substantially rigid in a direction extending transversely to the longitudinal direction of the rail. It is preferably provided that the at least one protrusion is formed as an embossing on one of the rails. Alternatively, it is possible that the protrusion can also be configured so as to be elastically yieldable and/or can be fixed to one of the rails (for example by screwing or bonding).

According to an embodiment, at least two spring element are arranged on the first or second rail, the at least two spring element being spaced from each other in the longitudinal direction of the rail and co-operating with at least two protrusions spaced from each other in the longitudinal direction of the other rail in a connected condition of the first and second rail. Accordingly, the two rails are arranged to one another without clearance in a direction extending transversely to the longitudinal direction at least in that regions in which the at least two spring spaced from each other in the longitudinal direction bear against their associated protrusions.

Each of the at least two spring element and/or the at least two protrusions can be configured so as to have a different height. According to a first variant, upon sliding the first rail onto the second rail, a spring element having a smaller height is configured to be moved past a protrusion having a smaller height, and the spring element having the smaller height bears against a protrusion having a larger height in a connected condition of the first and second rail.

According to a second variant, upon sliding the first rail onto the second rail, a protrusion having a smaller height is configured to be moved past a spring element having a smaller height, and the protrusion having the smaller height bears against a spring element having a larger height in a connected condition of the first and second rail.

Both variants have the advantage that the drawer can be smoothly slid onto the second rail by a person, because the protrusion and the spring element are configured to be moved past one another, preferably by the formation of a gap or possibly only with low friction. Only in the connected condition or immediately before reaching the connected condition, a play-free connection can be established between the two rails due to the protrusions bearing against the spring element.

The drawer pull-out guide according to the invention comprises a carcass rail to be fixed to a furniture carcass, and at least one drawer rail of the described type, and the drawer rail is displaceably supported relative to the carcass rail. In order to enable a full extension of the drawer relative to the furniture carcass, an additional central rail can be provided, the central rail being displaceably supported between the carcass rail and the drawer rail.

The item of furniture according to the invention comprises a furniture carcass and a drawer displaceably supported relative to the furniture carcass, the first rail being pre-mounted to the drawer and the second rail being pre-mounted to the furniture carcass, and the first rail connected to the drawer can be connected to the second rail by sliding the first rail onto the second rail.

BRIEF DESCRIPTION OF THE DRAWINGS

Further details and advantages of the present invention will be explained with the aid of the following description of figures, in which.

DETAILED DESCRIPTION OF THE INVENTION

Figure 1:
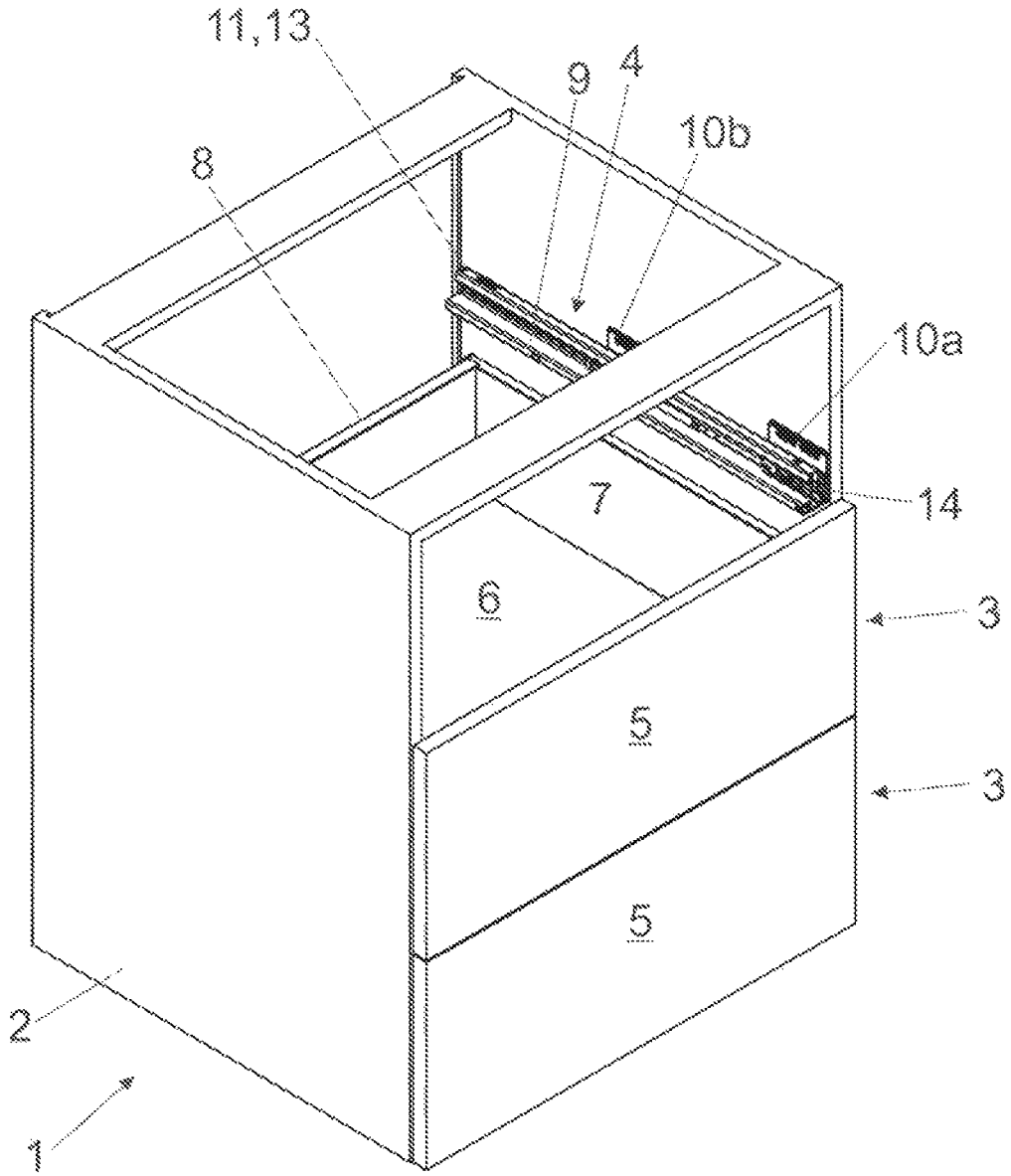
FIG. 1 shows a perspective view of an item of furniture with drawers displaceably supported relative to the furniture carcass by drawer pull-out guides.

FIG. 1 shows an item of furniture 1 having a cupboard-shaped furniture carcass 2, and drawers 3 are displaceably supported relative to the furniture carcass 2 by drawer pull-out guides 4. Each of the drawers 3 includes a front panel 5, a drawer bottom 6, sidewalls 7 and a rear wall 8. Each of the drawer pull-out guides 4 includes a carcass rail 9 to be fixed to the furniture carcass 2 by fastening portions 10*a*,10*b*, and at least one drawer rail 11 displaceably supported relative to the carcass rail 9. The drawer rail 11 has at least a two-part configuration and includes a first rail 12 (FIG. 2*a*) fixed or configured to be fixed to the drawer 3, and a second rail 13 arranged or configured to be arranged on the drawer pull-out guide 4. In order to enable a full extension of the drawer 3 relative to the furniture carcass 2, an additional central rail 14 may be provided, the central rail 14 being displaceably supported between the carcass rail 9 and the drawer rail 11. The drawers 3 are mounted to the drawer pull-out guides 4 such that the drawer 3 is initially placed onto the second rails 13 arranged on opposing sides of the furniture carcass 2. Subsequently, the first rails 12 fixed to the drawer 3 are slid onto the second rails 13, until the first and second rails 12, 13 are automatically locked to one another, so that the first and second rails 12, 13 are arranged so as to be stationary to one another in a connected condition. The locking of the rails 12, 13 to one another can be established by a conventional locking device 23 (FIG. 4*a*) which is known according to the prior art and needs not to be explained in greater detail here.

Figure 2A:
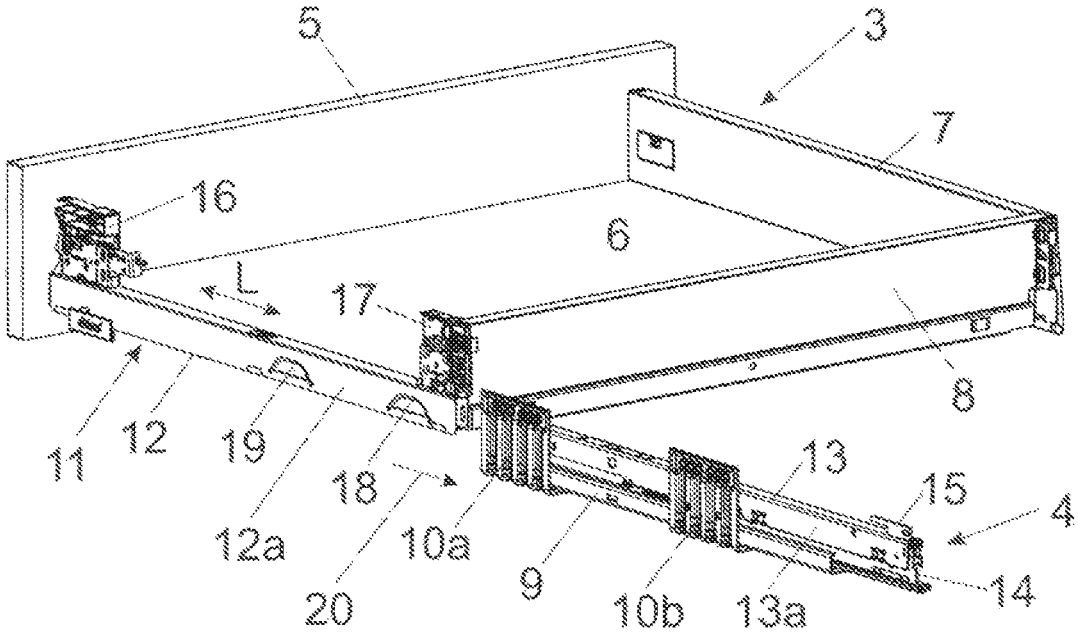
FIG. 2*a*, 2*b* show perspective views of the drawer to be fixed to the drawer pull-out guide, and the drawer which is fixed to the drawer pull-out guide.

FIG. 2*a* shows a perspective view of the drawer 3 to be fixed to the furniture carcass 4, in which a sidewall 7 of the drawer 3 is hidden for the sake of improved overview. Visible is the first rail 12 of the drawer rail 11, the first rail 12 being arranged on the drawer 3. A first fastening adaptor 16 for fixing the front panel 5 is arranged on the front-end region of the first rail 12, and a second fastening adaptor 17 for fixing the rear wall 8 is arranged on a rear-end region of the first rail 12. The first rail 12 includes two side limbs 12*a* extending in a longitudinal direction (L) of the first rail 12, and the side limbs 12*a* are spaced from each other substantially in a parallel relationship. At least one spring element 18 in the form of an elastically bendable spring tab is arranged on one of the side limbs 12*a*. In the shown embodiment, two spring elements 18, 19 are provided on the first rail 12, and the spring elements 18, 19 are spaced from each other in the longitudinal direction (L) and have an integral one-piece construction with the first rail 12.

The carcass rail 9 of the drawer pull-out guide 4 is to be mounted to the furniture carcass 2 via the fastening portions 10*a*, 10*b*, and the second rail 13 of the drawer rail 11 and the central rail 14 are displaceably supported relative to the stationary carcass rail 9. The drawer 3 is to be mounted to the second rail 13 such that the two first rails 12 arranged on the sidewalls 7 of the drawer 3 are slid onto the second rails 13 of the drawer pull-put guides 4 in a direction of the depicted arrow 20.

Figure 2B:
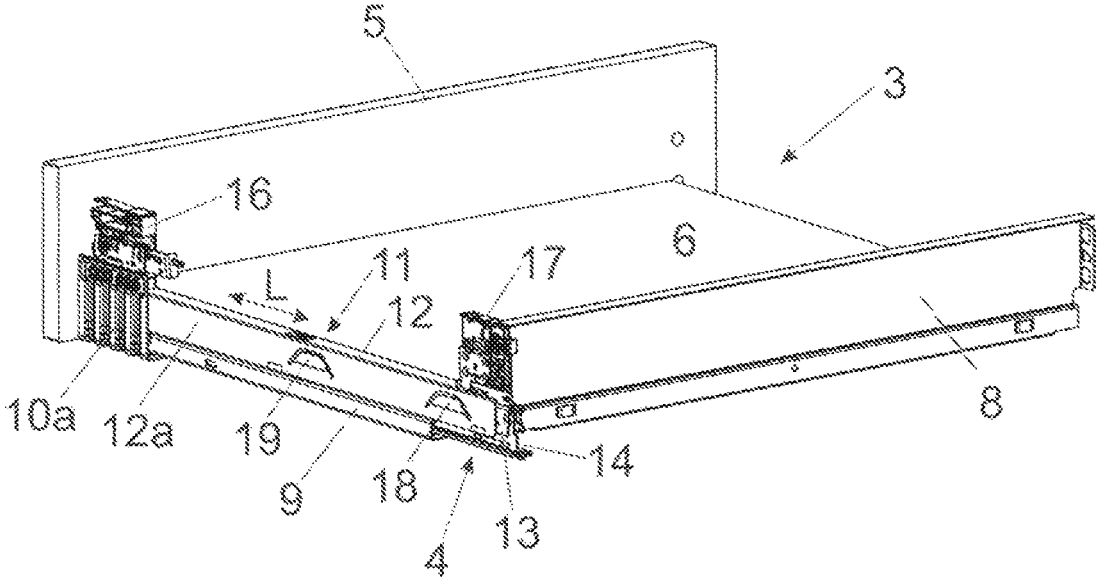

FIG. 2*b* shows the connected condition of the drawer 3 on the drawer pull-out guide 4, and the second rail 13 is received within a U-shaped profile, seen in a cross section, of the first rail 12. The rails 12, 13 are arranged in a play-free manner in a direction extending transversely to the longitudinal direction (L), preferably in a direction lateral to the longitudinal direction (L), of the rails 12, 13 due to the arrangement of the spring elements 18, 19. In the shown embodiment, the spring elements 18, 19 are configured so as to have an approximately trapezoid form having base sides extending parallel to one another, and the longer base sides of the trapezoid spring elements 18, 19 are arranged stationary relative to the first rail 12, and the shorter base sides are configured so as to be elastically bendable in a direction extending transversely to the longitudinal direction (L).

Figure 3A:
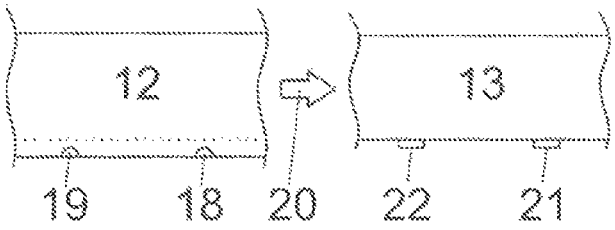
FIG. 3*a*-3*h* show schematic top views onto the first and second rail with different arrangements of the spring element and the protrusions.
Figure 3B:
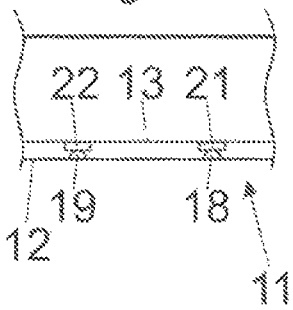

FIG. 3*a*-3*h* show schematic top views onto the first rail 12 and the second rail 13 with different arrangements of the spring means (spring elements) 18, 19 and the protrusions 21, 22. When the drawer 3 is mounted, the first rail 12 is to be slid onto the second rail 13 in a direction of the depicted arrow 20. FIG. 3*a* shows a first embodiment, in which two spring means 18, 19 having a substantially identical height are arranged on the first rail 12 so that a first surface of the spring elements 18, 19 face the second rail 13, the spring means 18, 19 being spaced from one another in the longitudinal direction (L). On the second rail 13, two protrusions 21, 22 having substantially an identical height are arranged so that a second surface of the protrusions 21, 22 faces the first rail 12 in the connected condition, the protrusions 21, 22 being spaced from one another in the longitudinal direction (L). FIG. 3*b* shows the connected condition of the first and second rail 12, 13, the first surface of the spring means 18, 19 and the second surface of the protrusions 21, 22 bearing against one another so as to limit transverse movements of the two rails 12, 13 relative to one another. Of course, these arrangements can be reversed, with the spring elements 18, 19 on the second rail 13 and the protrusions 21, 22 on the first rail 12, as shown in FIGS. 3*e* through 3*h*.

Figure 3C:
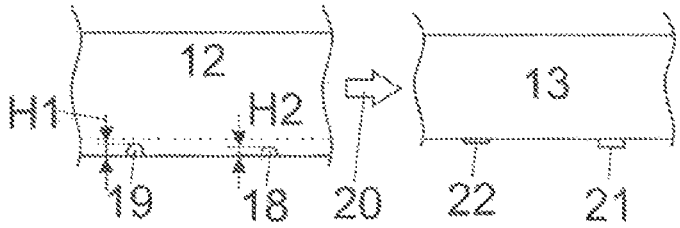
Figure 3D:
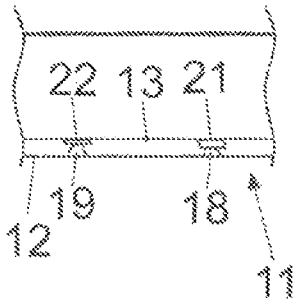

FIG. 3*c* shows a second embodiment, in which two spring elements 18, 19 having a different height H1, H2 are arranged on the first rail 12, the spring elements 18, 19 being spaced from one another in the longitudinal direction (L). On the second rail 13, two protrusions 21, 22 having a different height are arranged. This has the particular advantage that the spring element 18 having the lower height H2, upon sliding the first rail 12 onto the second rail 13 in the direction of the arrow 20, can be moved past the protrusion 22 having a lower height, preferably with a predetermined distance. Therefore, the first rail 12 can be slid onto the second rail 13 with low friction. In FIG. 3*d*, the connected condition between the first and second rail 12, 13 is shown, and the spring element 18 having a lower height H2 bears against a protrusion 21 having a larger height, and the spring element 19 having a larger height H1 bears against a protrusion 22 having a lower height.

Figure 3E:
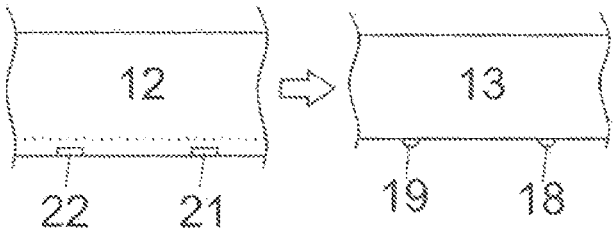
Figure 3F:
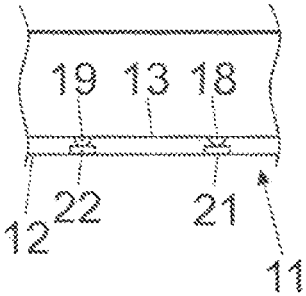

FIG. 3*e* shows a third embodiment, in which two protrusions 21, 22 having an identical height are arranged on the first rail 12, the protrusions 21, 22 being spaced from one another in the longitudinal direction (L). On the second rail 13, two spring elements 18, 19 having substantially an identical height are arranged. FIG. 3*f* shows the connected condition of the first and second rail 12, 13, and the protrusions 21, 22 of the first rail 12 bear against the spring elements 18, 19 of the second rail 13.

Figure 3G:
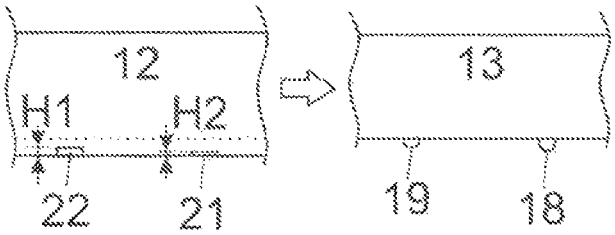
Figure 3H:
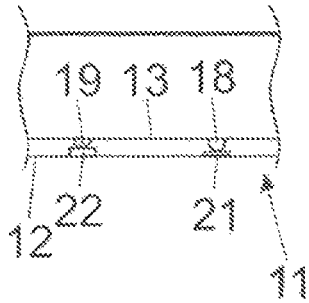

FIG. 3*g* shows a fourth embodiment, in which two protrusions 21, 22 are arranged on the first rail 12, the protrusions 21, 22 being spaced from one another in the longitudinal direction (L) and having a different height H1, H2. Two spring elements 18, 19 are provided on the second rail 13, the two spring elements 18, 19 protruding from the second rail 13 to different extents. FIG. 3*h* shows the connected condition of the first and second rail 12, 13, and the protrusion 21 having the smaller height H2 bears against the first spring element 18 having the larger height, the protrusion 21 being arranged on the rear-end region of the first rail 12. The front protrusion 22 having the larger height H1 bears against the second spring element 19 having the smaller height. This embodiment also has the advantage that the protrusion 21 having the smaller height H2, upon sliding the first rail 12 onto the second rail 13, does not co-operate with the protrusion 19 of the second rail 13 in a wiping manner, so that the first rail 12 can be connected to the second rail 13 with a reduced manual effort and with reduced noise emissions.

Figure 4A:
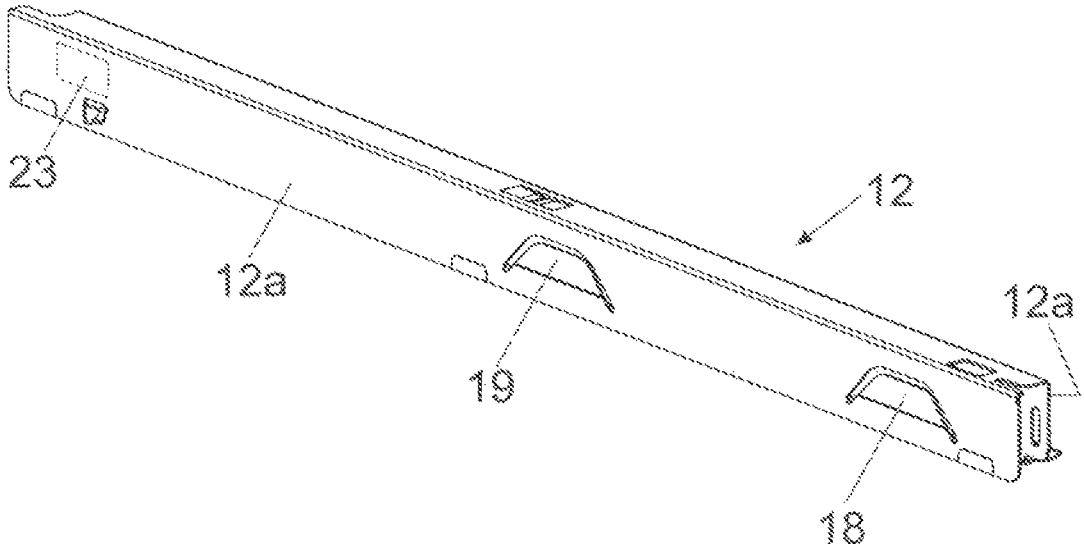
FIG. 4*a*-4*c* show different views of the first rail which is fixed or which is configured to be fixed to the drawer.

FIG. 4*a* shows the first rail 12 fixed or configured to be fixed to the drawer 3 in a perspective view. The first rail 12 includes a U-shaped profile portion in a cross-section, the U-shaped profile portion having two vertical side limbs 12*a* extending parallel to one another, and the spring elements 18, 19 are formed or arranged on at least one side limb 12*a*. In the front-end region of the first rail 12, a (schematically depicted) locking device 23 is arranged. The first and second rail 12, 13 can be releasably connected to one another by the locking device 23, so that the first and second rail 12, 13, in the connected condition, are non-displaceable relative to one another in the longitudinal direction (L). For example, the locking device 23 can include a resilient locking lever arranged on the first rail 12 or on the drawer 3, and the locking lever engaging in a corresponding opening of the second rail 13 in the connected condition of the first and second rail 12, 13.

Figure 4B:
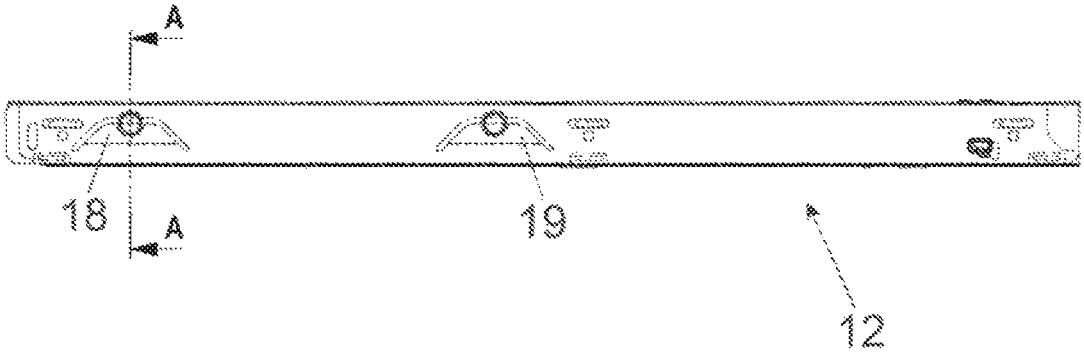
Figure 4C:
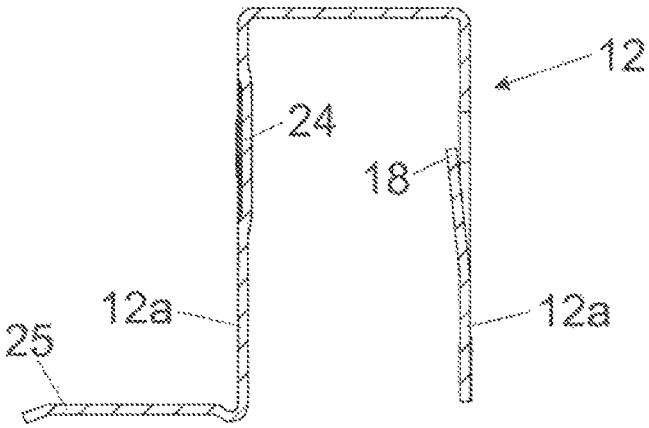

FIG. 4*b* shows a side view of the first rail 12, and the spring elements 18, 19 are preferably arranged in a rear half of the first rail 12. FIG. 4*c* shows a cross-sectional view of the first rail 12 along the plane A-A according to FIG. 4*b*, in which the vertical and parallel extending side limbs 12*a* of the first rail 12 can be seen. A protrusion 24 is arranged on a first side limb 12*a*, and the spring element 18 is arranged on the opposing second side limb 12*a*. The spring element 18, in a resting condition, protrudes into a cavity delimited by the side limbs 12*a*. By the co-operation with the protrusion 21 arranged on the second rail 13, the spring element 18 can be pressed, against a resilient force of the spring element 18, in a direction of a position in which the spring element 18 is arranged flush with the side limb 12*a*. The first rail 12 further includes a support limb 25 for the drawer bottom 6, the support limb 25 extending horizontally in the mounted position.

Figure 5A:
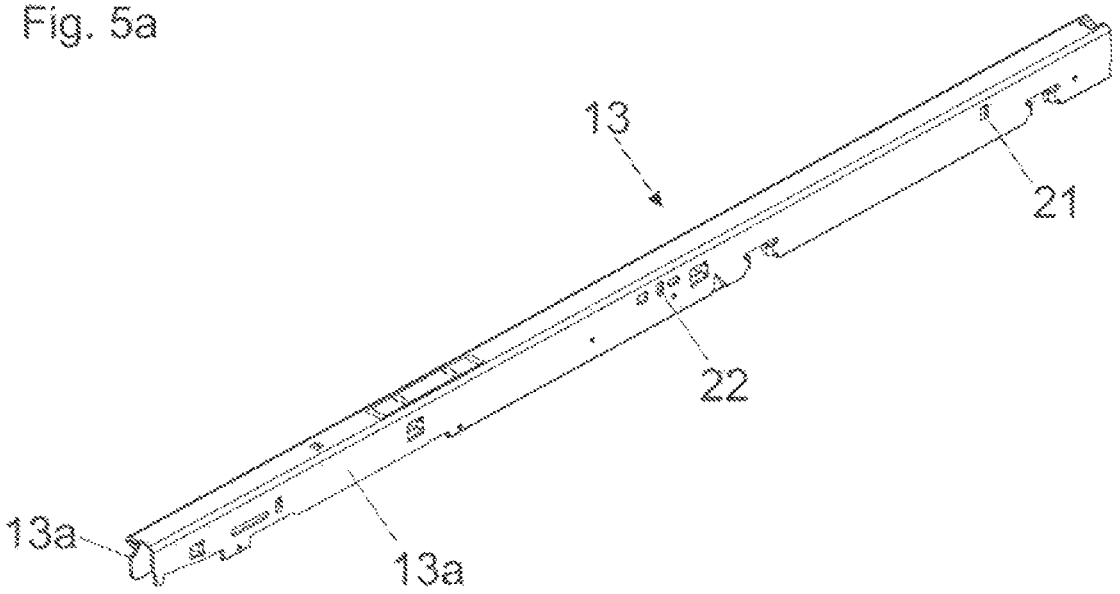
FIG. 5*a*-5*e* show different views of the second rail which is arranged or which is configured to be arranged on the drawer pull-out guide, and two cross-sectional views of the rails being connected to one another.

FIG. 5*a* shows a perspective view of the second rail 13 arranged or configured to be arranged on the drawer pull-out guide 4. The second rail 13 also includes a U-shaped profile portion having two vertical side limbs 13*a* extending parallel to one another, and the second rail 13 is configured to be received within the U-shaped portion of the first rail 12. The protrusions 21, 22 are arranged on at least one of the side limbs 13*a*, and it is preferably provided that the rear protrusion 21 (i.e., the protrusion at the rear-end region of the second rail 13) is larger than the front protrusion 22.

Figure 5B:
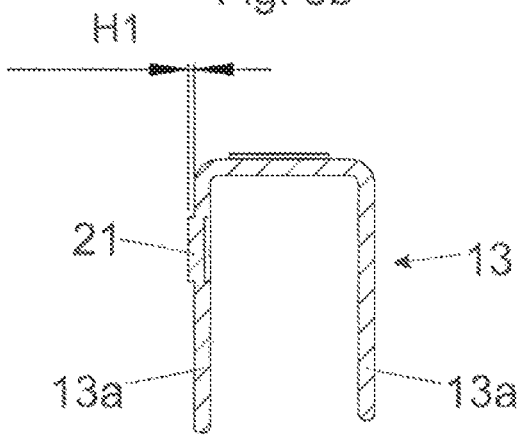
Figure 5C:
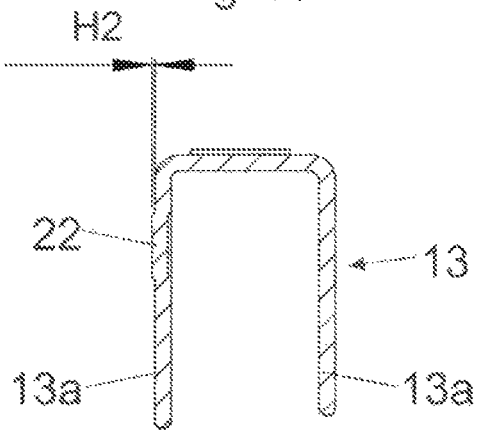

FIG. 5*b* shows a cross-sectional view of the second rail 13 in a region of the protrusion 21 having the larger height H1. The height H1 of the larger protrusion 21 can lie between 0.3 mm and 0.6 mm, preferably between 0.4 mm and 0.5 mm. FIG. 5*c* shows a cross-sectional view of the second rail 13 in a region of the protrusion 22 having the smaller height H2. The height H2 of the smaller protrusion 22 can lie between 0.1 mm and 0.4 mm, preferably between 0.2 mm and 0.3 mm.

Figure 5D:
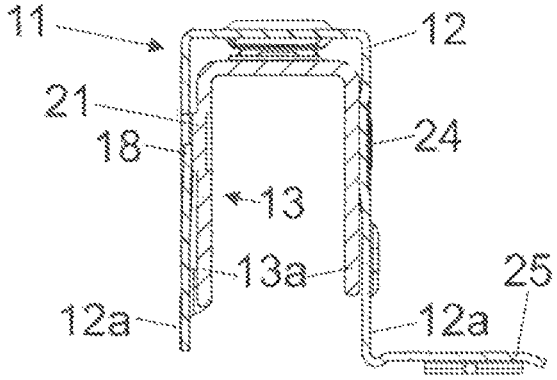
Figure 5E:
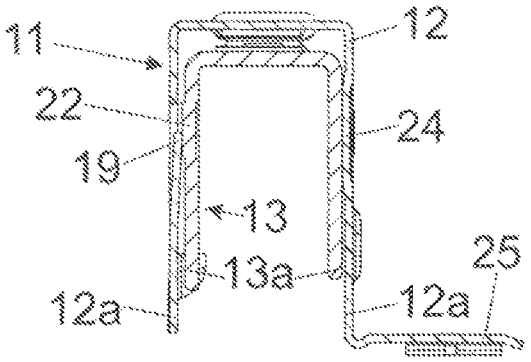

FIG. 5*d* shows a cross-sectional view of the connected condition of the first and second rail 12, 13 in a region of the protrusion 21 having the larger height H1, and the rails 12, 13 jointly form the drawer rail 11 for the drawer pull-out guide 4. The larger protrusion 21 of the second rail 13 bears against the spring element 18 of the first rail 12, whereas the opposing protrusion 24 of the first rail 12 bears against a side limb 13*a* of the second rail 13 in a play-free manner, so that the second rail 13 is centered relative to the first rail 12 and transverse movements of the rails 12, 13 relative to one another can be limited. FIG. 5*e* shows a cross-sectional view of the connected condition of the first and second rail 12, 13 in a region of the protrusion 22 having the smaller height H2.

The invention claimed is:

1. A drawer rail for a drawer pull-out guide, the drawer rail comprising:

a first rail configured to be fixed to a drawer;

a second rail configured to be arranged on a carcass rail or on a central rail of a drawer pull-out guide, the first rail and the second rail being configured to be connected to one another by sliding onto each other;

a spring element elastically arranged on a first one of the first rail or the second rail; and a protrusion arranged on a second one of the first rail or the second rail, the position and extension of the protrusion on the second one of the first rail or the second rail being such that the protrusion, in a connected condition of the first rail and the second rail, co-operates with the spring element so as to limit transverse movements of the first rail and the second rail relative to one another, wherein the spring element and the first one of the first rail and the second rail have an integral one-piece construction, and wherein the spring element has a first surface facing the second one of the first rail or the second rail, and the protrusion has a second surface facing the first one of the first rail or the second rail such that the first surface and the second surface bear against each other in a connected condition of the first rail and the second rail.

2. The drawer rail according to claim 1, wherein the first rail, starting from a front-end region of the second rail, can be slid towards a rear-end region of the second rail, wherein the protrusion co-operates with the spring element only over a partial region immediately preceding the rear-end region of the second rail.

3. The drawer rail according to claim 1, wherein each of the first rail and the second rail includes a side limb extending in a longitudinal direction of the rails, wherein the spring element and the protrusion are each located on a side limb of a respective one of the first rail and the second rail.

4. The drawer rail according to claim 3, wherein each of the spring element and the protrusion protrudes transversely from the side limb of the respective one of the first rail and the second rail.

5. The drawer rail according to claim 1, wherein the protrusion has an integral one-piece configuration with the second one of the first rail and the second rail.

6. The drawer rail according to claim 1, wherein the spring element is elastically bendable or reversibly deformable in a direction extending transversely to a longitudinal direction of the rail.

7. The drawer rail according to claim 1, wherein the protrusion is configured so as to be substantially rigid in a direction extending transversely to a longitudinal direction of the rail.

8. The drawer rail according to claim 1, wherein the first rail and the second rail, in a connected condition, are releasably connected to one another by a locking device, so that the first rail and the second rail are non-displaceable relative to one another.

9. A drawer pull-out guide comprising:

a carcass rail to be fixed to a furniture carcass; and the drawer rail according to claim 1, wherein the drawer rail is displaceably supported relative to the carcass rail.

10. The drawer pull-out guide according to claim 9, further comprising a central rail displaceably supported between the carcass rail and the drawer rail.

11. An item of furniture comprising:

a furniture carcass;

a drawer displaceably supported relative to the furniture carcass; and the drawer rail according to claim 1, wherein the first rail is pre-mounted to the drawer and the second rail is pre-mounted to the furniture carcass, and the first rail pre-mounted to the drawer is configured to be connected to the second rail by sliding the first rail onto the second rail.

12. The drawer rail according to claim 6, wherein the spring element is a spring tab or a spring tongue on one of the first rail and the second rail.

13. The drawer rail according to claim 7, wherein the protrusion is an embossing on one of the first rail and the second rail.

14. A drawer rail for a drawer pull-out guide, the drawer rail comprising:

a first rail configured to be fixed to a drawer;

a second rail configured to be arranged on a carcass rail or on a central rail of a drawer pull-out guide, the first rail and the second rail being configured to be connected to one another by sliding onto each other;

a spring element arranged on a first one of the first rail or the second rail; and a protrusion arranged on a second one of the first rail or the second rail, the position and extension of the protrusion on the second one of the first rail or the second rail being such that the protrusion, in a connected condition of the first rail and the second rail, co-operates with the spring element so as to limit transverse movements of the first rail and the second rail relative to one another, wherein the spring element and the first one of the first rail and the second rail have an integral one-piece construction, wherein the spring element is one of at least two spring elements arranged on the first one of the first rail or the second rail, and the protrusion is one of at least two protrusions arranged on the second one of the first rail or the second rail, the at least two spring elements being spaced apart from each other in a longitudinal direction of the first one of the first rail or the second rail and co-operating with the at least two protrusions spaced from each other in the longitudinal direction on the second one of the first rail or the second rail in a connected condition of the first rail and the second rail.

15. The drawer rail according to claim 14, wherein each of the at least two spring elements and/or each of the at least two protrusions has a different height.

16. The drawer rail according to claim 15, wherein, upon sliding the first rail onto the second rail, a spring element having a smaller height is configured to be moved past a protrusion having a smaller height, and the spring element having the smaller height bears against a protrusion having a larger height in a connected condition of the first rail and the second rail.

17. The drawer rail according to claim 15, wherein, upon sliding the first rail onto the second rail, a protrusion having a smaller height is configured to be moved past a spring element having a smaller height, and the protrusion having the smaller height bears against a spring element having a larger height in a connected condition of the first rail and the second rail.

18. A drawer rail for a drawer pull-out guide, the drawer rail comprising:

a first rail configured to be fixed to a drawer;

a second rail configured to be arranged on a carcass rail or on a central rail of a drawer pull-out guide, the first rail and the second rail being configured to be connected to one another by sliding onto each other;

a spring element arranged on a first one of the first rail or the second rail; and a protrusion arranged on a second one of the first rail or the second rail, the position and extension of the protrusion on the second one of the first rail or the second rail being such that the protrusion, in a connected condition of the first rail and the second rail, co-operates with the spring element so as to limit transverse movements of the first rail and the second rail relative to one another, wherein the protrusion is arranged on a rear-end region of the second one of the first rail or the second rail, and wherein the spring element is one of at least two spring elements arranged on the first one of the first rail or the second rail, and the protrusion is one of at least two protrusions arranged on the second one of the first rail or the second rail, the at least two spring elements being spaced apart from each other in a longitudinal direction of the first one of the first rail or the second rail and co-operating with the at least two protrusions spaced from each other in the longitudinal direction on the second one of the first rail or the second rail in a connected condition of the first rail and the second rail.

19. The drawer rail according to claim 18, wherein each of the at least two spring elements and/or each of the at least two protrusions has a different height.

* * * * *